US005751312A

United States Patent [19]

Gibson

[11] Patent Number: 5,751,312

[45] Date of Patent: May 12, 1998

[54] METHOD OF INHIBITING A PRINT ARTIFACT ASSOCIATED WITH A PRINTER PAUSE

[75] Inventor: Bruce David Gibson, Lexington, Ky.

[73] Assignee: Lexmark International, Inc., Lexington, Ky.

[21] Appl. No.: 708,328

[22] Filed: Sep. 4, 1996

[51] Int. Cl.[6] ..... B41J 2/21; B41J 2/205

[52] U.S. Cl. ..... 347/43; 347/15

[58] Field of Search ..... 347/40, 43, 37, 347/13, 15

[56] References Cited

U.S. PATENT DOCUMENTS

| | | | |
|---|---|---|---|
| 5,109,234 | 4/1992 | Otis, Jr et al. | 347/14 |
| 5,274,400 | 12/1993 | Johnson et al. | 347/43 |
| 5,276,467 | 1/1994 | Meyer et al. | 347/19 |
| 5,500,661 | 3/1996 | Matsubara et al. | 347/41 |

FOREIGN PATENT DOCUMENTS

| | | | |
|---|---|---|---|
| 378759 | 7/1990 | European Pat. Off. | B41J 2/51 |
| 568283 | 11/1993 | European Pat. Off. | H04N 1/18 |

*Primary Examiner*—N. Le
*Assistant Examiner*—Thinh Nguyen
*Attorney, Agent, or Firm*—Ronald K. Aust

[57] ABSTRACT

The invention is directed to a method of inhibiting a print artifact on a print medium using an ink jet printer. The ink jet printer includes a tri-color ink jet cartridge assembly with a cyan ink, magenta ink and yellow ink defining available color inks which may be selectively jetted onto the print medium. The ink jet cartridge assembly is scannable in a scan direction and the print medium is movable in an advance direction. During normal printing, the ink jet cartridge assembly is scanned across the print medium and prints on the print medium using the available color inks. When an impending printer pause is detected, the ink jet cartridge assembly is scanned across the print medium in a scan immediately prior to the printer pause and prints on the print medium using only the cyan ink and the yellow ink. Immediately after the printer pause, the ink jet cartridge assembly is scanned across the print medium without advancing the print medium in the advance direction and prints on the print medium using only the magenta ink.

17 Claims, 2 Drawing Sheets

| 62 PRIOR PRINT | 64 TIME DELAY | 66 PRINT LINE | 68 PRINT LINE | 70 PRINT LINE | 72 PRINT LINE | 74 PRINT LINE | 76 FINAL PRINT | |
|---|---|---|---|---|---|---|---|---|
| CMY | | (no paper index) | | | | | CMY | 50 |
| CMY | | | | | | | CMY | 52 |
| Y | | M | C | | | | CMY | 54 |
| Y | | | M | C | | | CMY | 56 |
| | | | Y | M | C | | CMY | 58 |
| | | | | Y | M | C | CMY | 60 |

METHOD OF INHIBITING A PRINT ARTIFACT ASSOCIATED WITH A PRINTER PAUSE

FIELD OF THE INVENTION

The present invention relates to a method of printing using a multi-color ink jet printer, and, more particularly, relates to a method of printing using a multi-color ink jet printer which is effective to inhibit a print artifact such as color banding.

DESCRIPTION OF THE RELATED ART

An ink jet printer typically includes an ink jet cartridge assembly which is scanned across a print medium, such as paper, in a direction substantially perpendicular to the advance direction of the paper. A multi-color ink jet cartridge assembly typically includes a plurality of sets of nozzles respectively associated with different color inks which are jetted onto the paper. For example, a tri-color ink jet cartridge assembly usually includes a set of nozzles associated with cyan ink which is jetted onto the paper, a set of nozzles associated with magenta ink which is jetted onto the paper, and a set of nozzles associated with yellow ink which is jetted onto the paper. The cyan nozzles, magenta nozzles and yellow nozzles are disposed adjacent to each other and sequentially arranged relative to the advance direction of the paper. The paper is advanced or indexed a distance corresponding to a common height of the three sets of nozzles between scans of the ink jet cartridge assembly such that the cyan, magenta and yellow inks are jetted onto respective scan lines on the paper during a scan of the cartridge assembly.

During normal printing, it is sometimes desirable or necessary to pause the printer for a certain time delay. For example, a printer pause may occur as a result of a maintenance cycle which is required by the printhead in order to provide consistent ink jetting performance. The maintenance cycle usually involves both jetting to purge dried ink from the nozzles and wiping of the nozzle plate to clear ink build-up and paper fibers. The time required to perform such a maintenance cycle can be several seconds. During the time delay associated with the maintenance cycle, the magenta ink is allowed additional time to dry and interact with the paper before the next color ink is applied in the next subsequent scan. This additional drying and interaction time may result in a noticeable print artifact such as horizontal color banding on the paper. Such color banding is not desirable.

It is also possible that a printer pause may result because of a delay in data transfer from the host computer to the ink jet printer. A printer pause resulting from a delay in data transfer to the ink jet printer, as well as any other source, may result in objectionable print artifacts being produced on the paper as indicated above.

What is needed in the art is a method of printing using a conventional ink jet printer which inhibits an objectionable print artifact from forming on the paper when a printer pause occurs.

SUMMARY OF THE INVENTION

The present invention provides a method of preventing color banding in a tri-color ink jet printer associated with a printer pause, in which only the cyan and yellow inks are jetted onto the print medium in the scan immediately prior to the pause and the magenta ink is jetted onto the print medium in the scan immediately after the pause without advancing the print medium.

The invention comprises, in one form thereof, a method of inhibiting a print artifact on a print medium using an ink jet printer. The ink jet printer includes a tri-color ink jet cartridge assembly with a cyan ink, magenta ink and yellow ink defining available color inks which may be selectively jetted onto the print medium. The ink jet cartridge assembly is scannable in a scan direction and the print medium is movable in an advance direction. During normal printing, the ink jet cartridge assembly is scanned across the print medium and prints on the print medium using the available color inks. When an impending printer pause is detected, the ink jet cartridge assembly is scanned across the print medium in a scan immediately prior to the printer pause and prints on the print medium using only the cyan ink and the yellow ink. Immediately after the printer pause, the ink jet cartridge assembly is scanned across the print medium without advancing the print medium in the advance direction and prints on the print medium using only the magenta ink.

An advantage of the present invention is that a print artifact such as color banding which occurs as a result of a printer pause during normal printing is inhibited.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
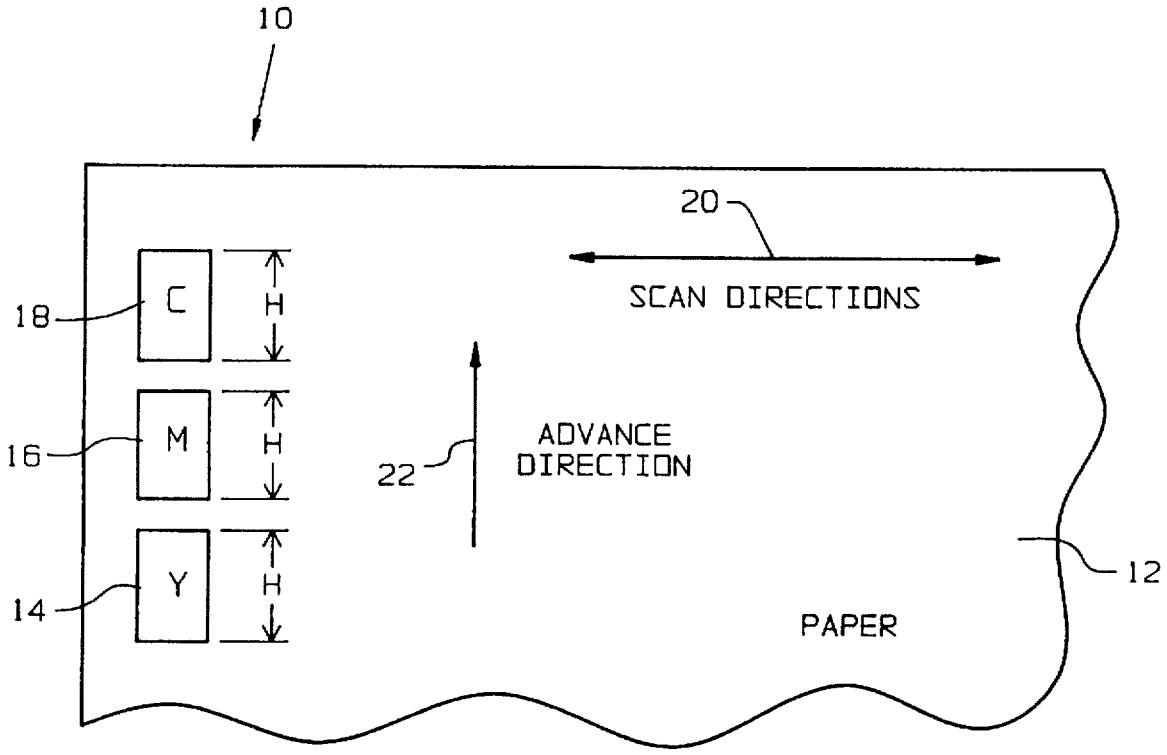
( PRIOR ART ) Fig. 1
FIG. 1 is a schematic, plan view of a portion of an ink jet cartridge assembly shown in relation to a portion of a print medium.

Referring now to the drawings and particularly to FIG. 1, there is shown a schematic illustration of a portion of an ink jet cartridge assembly 10 in relation to a portion of a print medium, such as paper 12. Ink jet cartridge assembly 10 forms part of an ink jet printer, and is a tri-color ink jet cartridge assembly including three sets of nozzles corresponding to yellow (Y) nozzles 14, magenta (M) nozzles 16 and cyan (C) nozzles 18. Each of the three sets of nozzles 14, 16 and 18 have a common height "H" and are respectively associated with a yellow ink, magenta ink and cyan ink which are selectively jetted onto paper 12. The yellow nozzles 14, magenta nozzles 16 and cyan nozzles 18 are sequentially arranged relative to the advance direction 22 of paper 12, respectively. Ink jet cartridge assembly 10, including nozzles sets 14, 16 and 18, is scannable in scan directions 20 which are generally perpendicular to an advance direction 22 of paper 12. Paper 12 is typically advanced in advance direction 22 a distance approximately equal to the common height "H" of the three sets of nozzles 14, 16 and 18.

The tri-color ink jet cartridge assembly 10 jets the yellow, magenta and cyan inks onto the print medium as it travels in a scan direction 20 across paper 12. Since the yellow, magenta and cyan sets of nozzles are sequentially arranged relative to the advance direction 22 of paper 12, the set of yellow nozzles 14 deposit yellow ink at predetermined pixel locations on paper 12 as ink jet cartridge assembly 10 is scanned across paper 12. In the next scan of ink jet cartridge assembly 10 after paper 12 is advanced in the advance direction 22 a distance corresponding to the height "H" of nozzle sets 14, 16 and 18, magenta ink is jetted onto paper 12 from the set of magenta nozzles 16 in the swath which previously received the yellow ink at selected pixel locations. Finally, for a particular scan line, paper 12 is again advanced in the advance direction 22 a distance corresponding to the height "H" of nozzle sets 14, 16 and 18, and cyan ink is jetted onto paper 12 at a particular scan line or swath as ink jet cartridge assembly 10 is scanned across paper 12. Thus, after three consecutive scans of ink jet cartridge assembly 10 across paper 12 in scan directions 20, the yellow, magenta and cyan inks are jetted onto paper 12 in a particular scan line or swath to complete the print for the particular swath.

As the printing process as described above occurs, print artifacts such as horizontal print density variations or color banding may occur on paper 12. Such color banding may be in the form of a visible horizontal band which extends across at least a portion of the paper. An example of such color banding may occur when the printer pauses during operation for any particular reason, e.g., as a result of a maintenance cycle or a delay in data transfer from the host computer.

Figure 2:
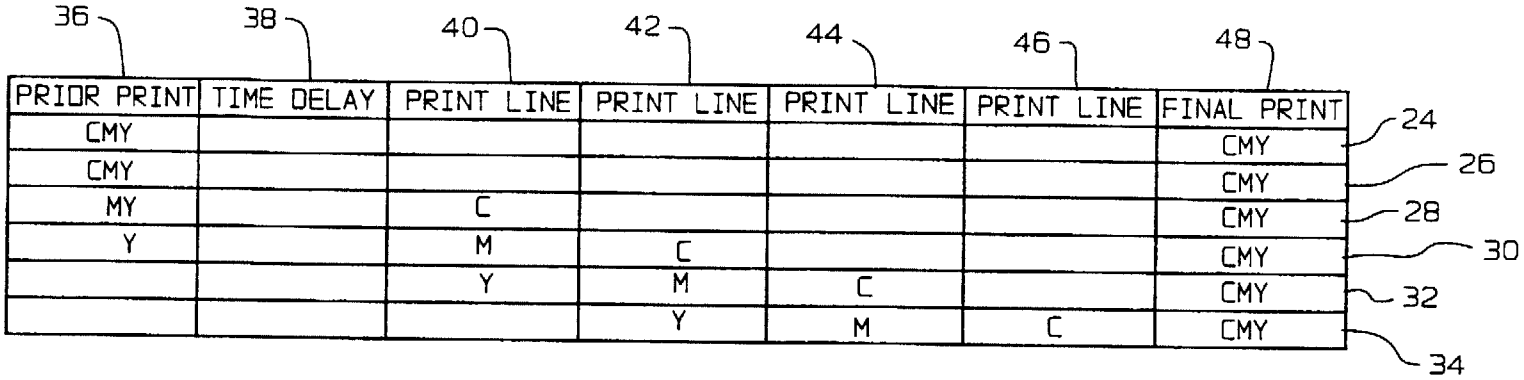
( PRIOR ART ) Fig. 2
FIG. 2 is a chart illustrating a conventional method of printing associated with a printer pause which occurs during normal printing.

Referring now to FIG. 2, a conventional method of printing on a print medium using an ink jet printer, which may include an ink jet cartridge 10 as shown in FIG. 1, is illustrated in graphical form. Each horizontal line 24, 26, 28, 30, 32 and 34 represents a scan line or swath in which the yellow, magenta and cyan inks are jetted during printing. In the embodiment shown, each scan line has a height which is equal to the common height of nozzle sets 14, 16 and 18. Moreover, each vertical column 36, 38, 40, 42, 44, 46 and 48 illustrates a state of the ink dots which are jetted onto paper 12 for a particular scan or period of time during the printing process.

In a scan 36 of ink jet cartridge assembly 10 across paper 12 immediately prior to time delay 38, scan line 30 receives yellow ink which is jetted thereon from yellow nozzles 14, scan line 28 receives magenta ink which is jetted thereon from magenta nozzles 16, and scan line 26 receives cyan ink which is jetted thereon from cyan nozzles 18. After completion of the print scan 36 immediately prior to the time delay 38, scan line 30 only contains yellow ink, scan line 28 contains magenta and yellow ink and scan line 26 contains cyan, magenta and yellow ink. During printer pause or time delay 38, no ink is jetted onto paper 12 from ink jet cartridge assembly 10. Such a printer pause or time delay 38 may result from a maintenance cycle or a delay in data being transferred to the printer from the host computer, as indicated above. After the time delay 38 occurs, ink jet cartridge assembly 10 is again moved in a scan 40 across paper 12 and yellow ink is jetted onto scan line 32, magenta ink is jetted onto scan line 30, and cyan ink is jetted onto scan line 28. The magenta ink which was jetted onto scan line 28 prior to time delay 38 had a longer period of time to dry and interact with the paper before the cyan ink is applied in scan 40 of ink jet cartridge assembly 10 across paper 12. This time delay 38 may result in a darker than normal horizontal color band which appears on paper 12 as an undesirable print artifact. Scans 42, 44 and 46 indicate that normal printing resumes with the successive jetting of yellow, magenta and cyan inks onto paper 12 during the printing process.

Figure 3:
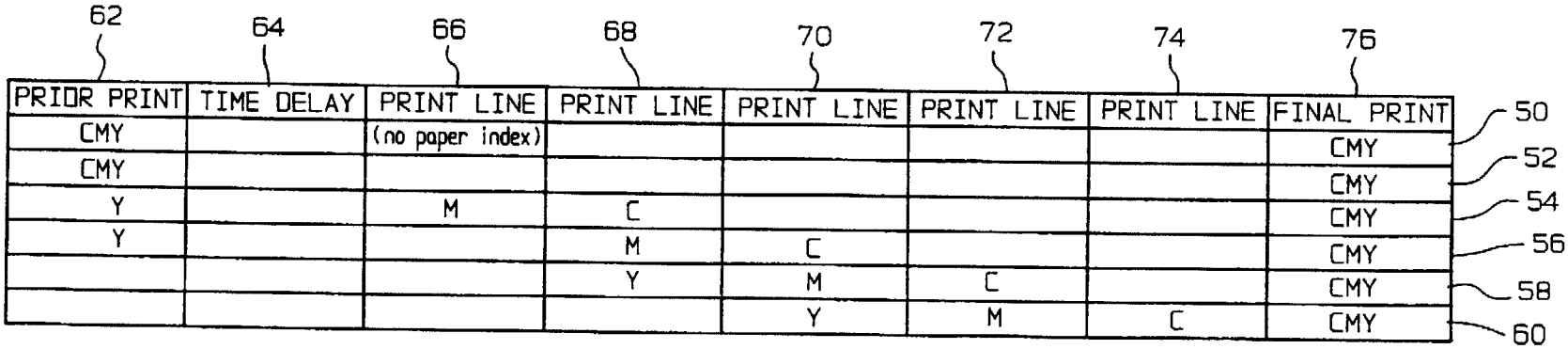
FIG. 3 is a chart illustrating an embodiment of a method of printing of the present invention associated with a printer pause which occurs during normal printing.

Referring now to FIG. 3, there is shown a chart which illustrates an embodiment of a method of printing of the present invention which may utilize the ink jet cartridge assembly 10 shown in FIG. 1 and is associated with a printer pause which occurs during normal printing. Horizontal lines 50, 52, 54, 56, 58 and 60 represent scan lines or swaths on paper 12. In the embodiment shown, each scan line has a height which is equal to the common height of nozzle sets 14, 16 and 18. Vertical columns 62, 64, 66, 68, 70, 72, 74 and 76 illustrate a state of the ink dots which are jetted onto paper 12 for a particular scan or period of time during the printing process.

In a scan 62 immediately prior to a time delay 64, cyan ink is jetted onto scan line 52 from cyan nozzles 18, and yellow ink is jetted onto scan line 56 from yellow nozzles 14. However, in contrast with the conventional method of printing shown in FIG. 2, ink jet cartridge assembly 10 is scanned across paper 12 in the scan 62 immediately prior to printer pause or time delay 64 without jetting the magenta ink from magenta nozzles 16 onto scan line 54. After the printer pause or time delay 64, ink jet cartridge assembly 10 is scanned across paper 12 in a scan 66 without advancing paper 12 in the advance direction 22, and only jetting magenta ink onto scan line 54 of paper 12. In the immediately following scan 68, cyan, magenta, and yellow ink are each jetted onto paper 12 and normal printing resumes thereafter in scans 70, 72 and 74.

Because the magenta ink is not jetted onto paper 12 in the scan 62 immediately prior to printer pause or time delay 64, the magenta ink does not have additional time in which to dry or interact with the paper before the cyan ink is applied to scan line 54 in scan 68. This has been found by the present inventor to be effective in reducing the horizontal color banding print artifact which may result when the conventional method shown in FIG. 2 is utilized.

Figure 4:
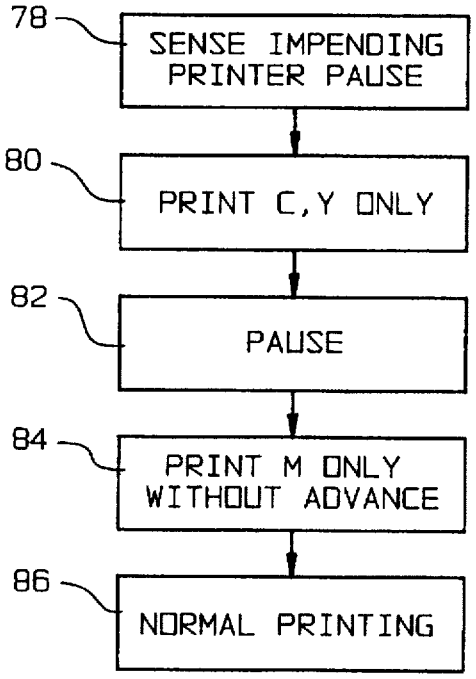
FIG. 4 is a flow chart illustrating the method shown in FIG. 2.

FIG. 4 is a flow chart illustrating the method shown in chart form in FIG. 3. At block 78, an impending printer pause is detected or sensed. In the scan immediately prior to the printer pause, only the cyan and yellow inks are jetted onto paper 12 from respective nozzles 18 and 14 of ink jet cartridge assembly 10 (block 80). After the printer pause which may occur as a result of, e.g., a maintenance cycle or delay in data transfer from the host computer (block 82), ink jet cartridge assembly 10 is scanned across paper 12 without advancing paper 12 in the advance direction 22 and only the magenta ink is jetted onto paper 12 from magenta nozzles 16 (block 84). Thereafter, normal printing resumes in which yellow ink, magenta ink and cyan ink are jetted onto respective scan lines of paper 12 during each scan of inkjet cartridge assembly 10 (block 86).

In the embodiment of the method of the present invention described above, the magenta ink is not printed on paper 12 in the scan immediately prior to a printer pause. However, it is also to be understood that a different color ink, or more than one color ink, may be determined to be an ink which is not printed on paper 12 in a scan immediately prior to a printer pause. A determination as to which color ink(s) to withhold as available color inks in the scan immediately prior to the printer pause may be dependent upon the type of print artifact which is to be inhibited.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of inhibiting a print artifact on a print medium using an ink jet printer, the ink jet printer including a tri-color ink jet cartridge assembly with a cyan ink, magenta ink and yellow ink defining available color inks which are selectively jetted onto the print medium, the ink jet cartridge assembly being scannable in a scan direction and the print medium being movable in an advance direction, said method comprising the sequential steps of:

scanning the ink jet cartridge assembly across the print medium and printing on the print medium using the available color inks;

detecting an impending printer pause associated with a time delay during normal printing;

scanning the ink jet cartridge assembly across the print medium in a scan immediately prior to said printer pause and printing on the print medium using only the cyan ink and the yellow ink;

pausing the printer; and scanning the ink jet cartridge assembly across the print medium in a scan immediately after said printer pause without advancing the print medium in the advance direction and printing on the print medium using only the magenta ink.

2. The method of claim 1, comprising the further steps, after said scanning step which follows said pausing step, of:

advancing the print medium in the advance direction; and printing on the print medium using the available color inks.

3. The method of claim 1, wherein the ink jet cartridge assembly comprises three sets of nozzles, each of said three sets of nozzles having a common height and being respectively associated with the yellow ink, magenta ink and cyan ink.

4. The method of claim 3, wherein the print medium is advanced in the advance direction a distance approximately equal to the common height of the three sets of nozzles.

5. The method of claim 4, wherein said three sets of nozzles correspond to yellow, magenta and cyan nozzles which are sequentially arranged relative to the advance direction of the print medium, respectively.

6. The method of claim 1, wherein the print artifact comprises a color banding artifact.

7. The method of claim 1, wherein said pausing step corresponds to a printer maintenance cycle.

8. The method of claim 1, wherein said pausing step corresponds to a delayed data transfer to the printer.

9. A method of inhibiting a print artifact on a print medium using an ink jet printer, the ink jet printer including an ink jet cartridge assembly with a plurality of available color inks which are selectively jetted onto the print medium, the ink jet cartridge assembly being scannable in a scan direction and the print medium being movable in an advance direction, said method comprising the sequential steps of:

setting at least one of the available color inks as a determined color ink;

scanning the ink jet cartridge assembly across the print medium and printing on the print medium using the available color inks;

detecting an impending printer pause associated with a time delay during normal printing;

scanning the ink jet cartridge assembly across the print medium in a scan immediately prior to said printer pause and printing on the print medium using the available color inks except the at least one determined color ink;

pausing the printer;

scanning the ink jet cartridge assembly across the print medium in a scan immediately after said printer pause without advancing the print medium in the advance direction; and printing on the print medium using only the at least one determined color ink during said third scanning step.

10. The method of claim 9, comprising the further steps after said scanning step which follows said pausing step of:

advancing the print medium in the advance direction; and printing on the print medium using the available color inks.

11. The method of claim 9, wherein the ink jet cartridge assembly comprises a tri-color ink jet cartridge assembly with three sets of nozzles, each of said three sets of nozzles having a common height and being respectively associated with three color inks.

12. The method of claim 11, wherein said three color inks comprise yellow, magenta and cyan inks, and wherein the print medium is advanced in the advance direction a distance approximately equal to the common height of the three sets of nozzles.

13. The method of claim 12, wherein said three sets of nozzles correspond to yellow, magenta and cyan nozzles which are sequentially arranged relative to the advance direction of the print medium, respectively.

14. The method of claim 9, wherein the print artifact comprises a color banding artifact.

15. The method of claim 9, wherein the at least one determined color ink comprises magenta ink.

16. The method of claim 9, wherein said pausing step corresponds to a printer maintenance cycle.

17. The method of claim 9, wherein said pausing step corresponds to a delayed data transfer to the printer.

* * * * *